US005234158A

United States Patent [19]

Storms et al.

[11] Patent Number: 5,234,158

[45] Date of Patent: Aug. 10, 1993

[54] TWO-PIECE CONTAINER FOR PIZZA OR THE LIKE

[75] Inventors: Brian H. Storms, Lakewood; David W. Spitz, Jamestown; Walter F. Mikus, East Aurora, all of N.Y.

[73] Assignee: Jamestown Container Corporation, Falconer, N.Y.

[21] Appl. No.: 860,482

[22] Filed: Mar. 30, 1992

[51] Int. Cl.[5] ..... B65D 5/36; B65D 5/68

[52] U.S. Cl. ..... 229/104; 229/114; 229/117.01; 229/175.28; 229/125.31; 229/906; 229/931; 426/115

[58] Field of Search ..... 229/104, 114, 117.01, 229/117.05, 117.06, 125.26, 125.28, 125.31, 178, 902, 903, 906, 917, DIG. 2, DIG. 4; 426/110, 113, 114, 115, 122, 128, 129, 130

[56] References Cited

U.S. PATENT DOCUMENTS

| | | | |
|---|---|---|---|
| 1,771,760 | 7/1930 | MacLellan | 229/DIG. 4 |
| 1,905,119 | 4/1933 | Newton | 229/114 |
| 1,980,667 | 11/1934 | Daley | 229/104 |
| 2,071,949 | 2/1937 | Reich | 229/104 |
| 2,483,063 | 9/1949 | Ray | 93/51 |
| 2,625,315 | 1/1953 | Fehrenkamp | 229/DIG. 4 |
| 2,645,405 | 7/1953 | Dorfman | 229/117.06 |
| 2,736,486 | 2/1956 | Rabby | 229/125.26 |
| 2,999,626 | 9/1961 | McDermott | 229/45 |
| 3,307,768 | 3/1967 | Growney | 229/117.01 |
| 3,342,322 | 9/1967 | Weisner et al. | 206/46 |
| 3,539,089 | 11/1970 | Osberg | 229/117.06 |
| 3,726,470 | 4/1973 | Naylor | 229/178 |
| 3,809,305 | 5/1974 | Persson | 229/45 |
| 3,861,582 | 1/1975 | Bock | 229/117.06 |
| 4,365,738 | 12/1982 | Densen | 229/917 |
| 4,798,323 | 1/1989 | Platt | 229/117.01 |
| 4,923,113 | 5/1990 | Guijarro | 229/125.27 |
| 4,960,238 | 10/1990 | Lorenz | 229/125.29 |
| 4,995,557 | 2/1991 | Fremion | 229/125.29 |
| 5,060,851 | 10/1991 | Lorenz | 229/125.29 |
| 5,071,062 | 12/1991 | Bradley et al. | 229/109 |

FOREIGN PATENT DOCUMENTS

| | | | |
|---|---|---|---|
| 2301440 | 9/1976 | France | 229/DIG. 4 |
| 673633 | 3/1990 | Switzerland | 229/117.05 |
| 302849 | 12/1928 | United Kingdom | 229/117.01 |

*Primary Examiner*—Gary E. Elkins

*Attorney, Agent, or Firm*—Hodgson, Russ, Andrews, Woods & Goodyear

[57] ABSTRACT

A two-piece container for pizza or the like. The base includes a first pair of opposite side walls having end flaps. A second pair of opposite side walls are each folded to have an outer portion and an inner portion with at least one tab on the terminal edge thereof for engaging a slot in the bottom wall. The end flaps are received between the inner and outer portions. Cut-outs are provided in the second pair of side walls for securely receiving tabs of the lid between the inner and outer portions. In one aspect, the inner and outer portions have the shapes of trapezoids providing trapezoidal-shaped second side walls to effect sloping side walls for nesting of the bases for compact storage. The sloping side walls are also provided to effect a more secure attachment of the lid to the base. In another aspect, the container is composed of corrugated cardboard and at least one fold line is provided in the bottom wall and the first pair of side walls for folding the base for disposal.

22 Claims, 2 Drawing Sheets

Fig. 1.
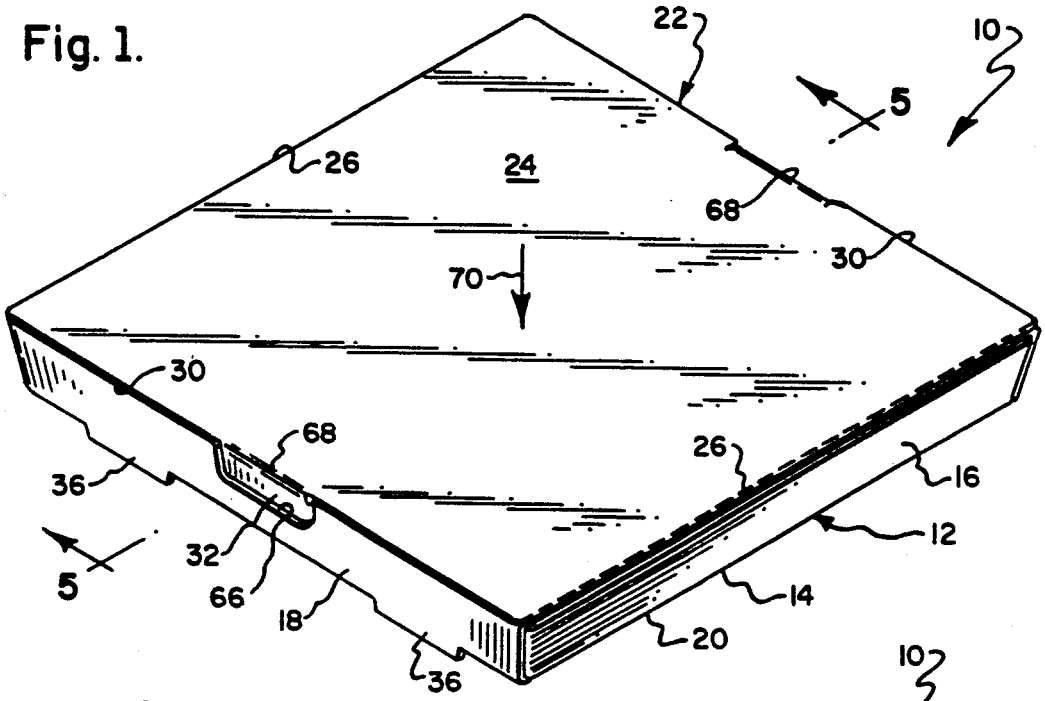
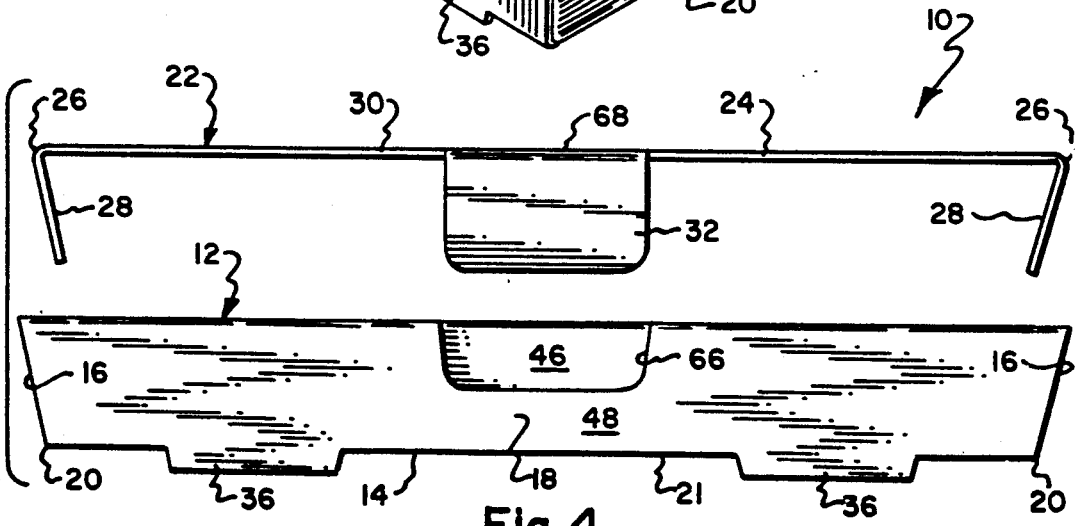
Fig. 4.
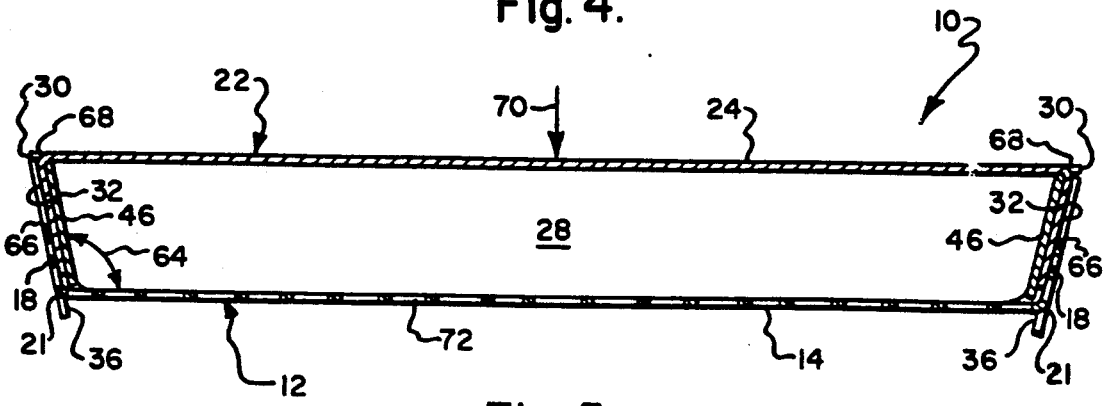
Fig. 5.

TWO-PIECE CONTAINER FOR PIZZA OR THE LIKE

The present invention relates generally to containers such as may be used as pizza boxes. However, it should be understood that the containers as described and claimed herein may be usable for other take-out foods or even for non-food items.

Pizza boxes have typically been constructed as a single piece from either thin cardboard or corrugated cardboard and with their side walls normal to the bottom wall, i.e., they do not slant with respect to the bottom wall. One of the side walls is folded so as to have an inner and an outer portion wherein the inner portion overlies the outer portion and has tabs along its terminal edge (an edge of the blank) to engage slots in the bottom wall, and flaps of the adjacent side walls are received between the inner and outer portions to form the box. The lid is integrally and foldably attached to the opposite side wall and has a tab which is inserted inwardly of the inner portion to close the box.

U.S. Pat. Nos. 4,960,238 to Lorenz; 4,995,557 to Fremion; and 5,060,851 to Lorenz disclose two-piece boxes for pizza or other food products. Lorenz '238 discloses a corrugated paper box with tapered side walls wherein flap sections along opposing side wall sections of a tray piece are received in complimentary slots in a cover piece, and the pieces are "squared-up" by glue flaps on side walls which are glued to the inner surfaces of adjacent side walls. Fremion discloses identical tray/cover pieces wherein one of a first pair of opposite side walls is attached to a second pair of opposite side walls by means of glue flaps formed to provide slots in the respective corners. The other of the first pair of side walls has tab elements which engage the slots for the other of the identical pieces Lorenz '851 discloses another configuration of complementary pieces with tapering side walls and with mating tab portions and cut-out portions in the facing edges of the side walls, and the pieces are "squared-up" by glue flaps on side walls which are glued to the inner surfaces of adjacent side walls.

Two-piece pizza boxes advantageously allow a smaller footprint of the box on the table, i.e., the lid may be removed out of the way and furthermore may be placed under the tray to insure against soak-through onto the table. The lid may be easily folded in half for more easily disposing of the pizza box. Although the tray cannot be recycled since it may have waste in it, the lid may advantageously still be recycled. Furthermore, the two-piece container allows advertising on the box to be changed at lesser cost since the printing on the lid may be modified without the necessity of changing the printing on the tray.

In order to provide a satisfactory two-piece pizza box, the box must be constructed so that the lid may be securely attached to the base so that it does not easily come loose therefrom and so that it may resist pressures on top of the lid which may otherwise deflect it so much that it undesirably bends inwardly to contact and perhaps ruin the pizza. It is also desirable that the base and the lid each be composed inexpensively of a single piece of cardboard which may be folded easily into shape without the use of glue or the like.

U.S. Pat. No. 3,342,322 to Weisner et al discloses a sausage casing carton of corrugated paper board with a removable lid wherein flaps on opposite edges of the lid are insertable in slots of the bottom section to be received between double walls constituting each of a first pair of side walls thereof. End flaps of a second pair of side walls of the bottom section are received between the double walls. The double walls are secured by means of tabs which extend from edges thereof to be received in slots in the bottom panel. Other art of interest includes U.S. Pat. Nos. 2,483,063; 2,999,626; 3,809,305; and 4,923,113.

Normal operations at a pizza shop may require that the boxes be folded into a position for use during a slack period of time so that they can be readily used during peak periods. However, when folded for use, such boxes take up a great deal of volume, yet space within a pizza shop may be at a premium. It is therefore desirable that the pizza boxes be nestable to minimize the amount of space taken up thereby. It is furthermore desirable that the boxes be insulated to prevent a rapid dissipation of heat so as to keep the pizza warm prior to its consumption while also providing adequate strength to prevent the lids from being pressed inwardly inadvertently to touch and perhaps ruin the pizza during normal use of the boxes. While the use of corrugated cardboard provides both the insulative and strength qualities desired, its use in a tray with upstanding side walls results in carton rigidity which makes its folding and hence disposal difficult.

It is accordingly an object of the present invention to provide a two-piece pizza box wherein blanks are easily folded to form it and wherein the lid may be tightly secured thereto and has sufficient capacity to resist downward pressure thereon which may cause the lid to contact and perhaps ruin a pizza therein.

It is another object of the present invention to provide such a pizza box which does not require glue or glued joints so as to reduce cost.

It is a further object of the present invention to provide such a pizza box wherein the trays are nestable so as to minimize the space that a number of trays take up within a pizza shop.

It is yet another object of the present invention to provide such a pizza box wherein the trays may be easily folded up for disposal without unduly sacrificing the strength thereof.

It is still another object of the present invention to provide such a pizza box which is inexpensive to manufacture, easy to fold into the box shape on-site, yet rugged and providing adequate protection to a pizza therein.

In accordance with the present invention, a pizza box is composed of corrugated cardboard in order to provide insulation as well as suitable strength The tray is formed from a single blank wherein the side walls are integrally and foldably attached to the edges of a bottom wall. Each of a first pair of opposite side walls has a pair of end flaps. Each of a second pair of opposite side walls is foldable upon itself to define an inner and an outer wall portion and to provide an edge adjacent the bottom wall. At least one tab extends from the edge of the inner wall portion to engage a corresponding slot in the bottom wall, and the end flaps are received between the inner and outer wall portions to form the tray. In order to allow stacking of the trays, the side walls are formed to slant outwardly from the bottom wall. In order to achieve such slanting side walls, the inner and outer wall portions are each provided with the shape of a trapezoid to effect a trapezoidal shape to each of the second pair of side walls whereby all of the side walls are prevented from coming to an upright position so that they slant at an angle to the bottom wall. In order to allow the pizza box to be easily folded so that it may be more easily disposed of, at least one fold line is provided in the bottom wall and the first pair of side walls. A cut-out is provided in each of the second pair of opposite side walls for receiving between the inner and outer wall portions tabs on the lid, the sloping side walls being provided to interact with the tabs to effect a resistance to downward pressure on the lid so that the lid does not contact and perhaps ruin the pizza.

The above and other objects, features, and advantages of the present invention will be apparent in the following detailed description of the preferred embodiments when read in conjunction with the accompanying drawings wherein like reference numerals denote the same or similar parts throughout the several views.

BRIEF DESCRIPTION OF THE DRAWINGS

FIG. 1 is a perspective view of a container which embodies the present invention.

FIG. 4 is a side view of the container of FIG. 1 in position for insertion of the lid into the tray.

FIG. 5 is a sectional view of the container of FIG. 1 taken along lines 5—5 thereof.

DETAILED DESCRIPTION OF THE PREFERRED EMBODIMENTS

Figure 2:
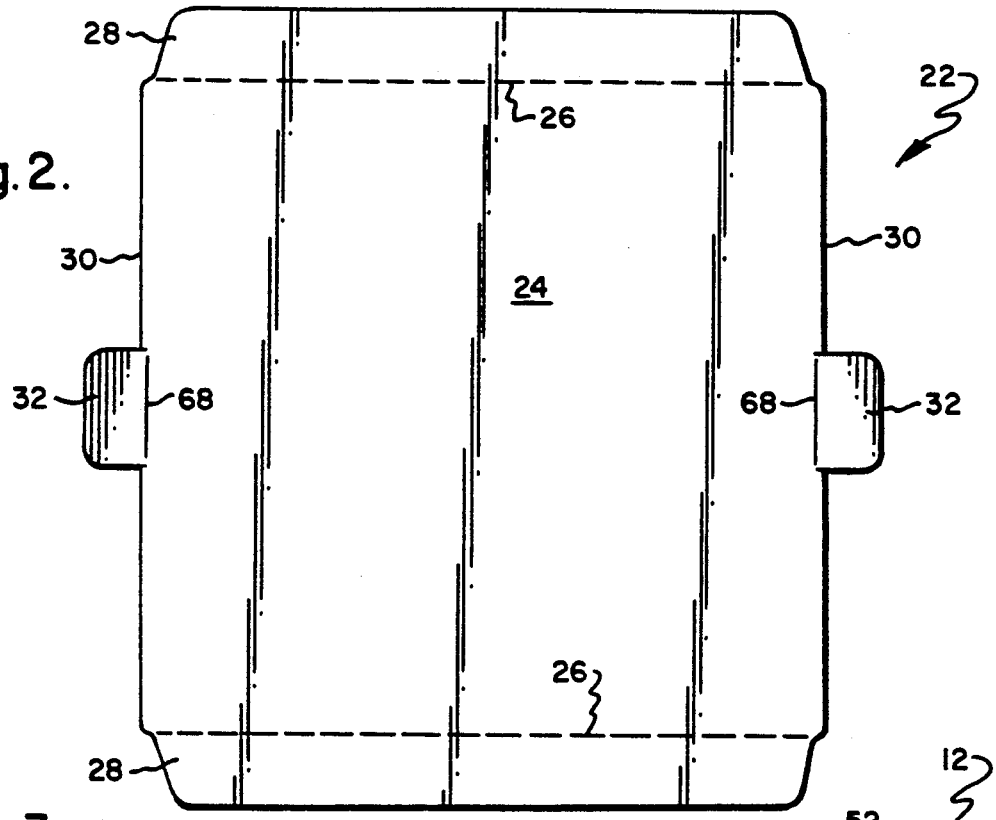
FIG. 2 is a plan view of a blank for the lid for the container of FIG. 1.

Referring to FIGS. 1, 4, and 5, there is shown generally at 10 a container for pizza or the like. The container 10 includes a tray or bottom member 12 having a bottom wall 14 which is of generally square shape for receiving pizza or other food or nonfood product. A first pair of opposite side walls 16 and a second pair of opposite side walls 18 are integrally and foldably attached to respective edges 20 and 21 of the bottom wall 14 and extend upwardly therefrom. For example, each edge 20 and 21 of the bottom wall 14 may have a length of perhaps about 15 inches, and the height of each wall 16 and 18 may perhaps be about 1¾ inch.

The container 10 also includes a lid 22 having an upper wall 24 having dimensions slightly larger than those of the bottom wall 14 in order to completely cover the top of the tray 12. Lid 22 also has a first pair of opposite side walls 28 integrally and foldably connected to the upper wall 24 at opposite edges 26 thereof. The lid side walls 28 are provided to engage the inner surfaces of the first pair of tray side walls 16 for attachment of the lid 22 to the tray 12. A tab 32 is integrally and foldably attached to each of a second pair of opposite edges 30 of the upper wall 24 and is positioned generally centrally of the length of the corresponding edge 30. The tabs 32 engage cut-outs 66 in the second pair of side walls 18 to secure the lid 22 to the tray 12 as will be described in greater detail hereinafter.

In order to provide adequate strength for securely attaching the lid 22 to the tray 12 while also affording insulation to the container 10 so that pizza therein may remain warm for a longer period of time, the lid 22 and tray 12 are constructed of corrugated cardboard.

Figure 3:
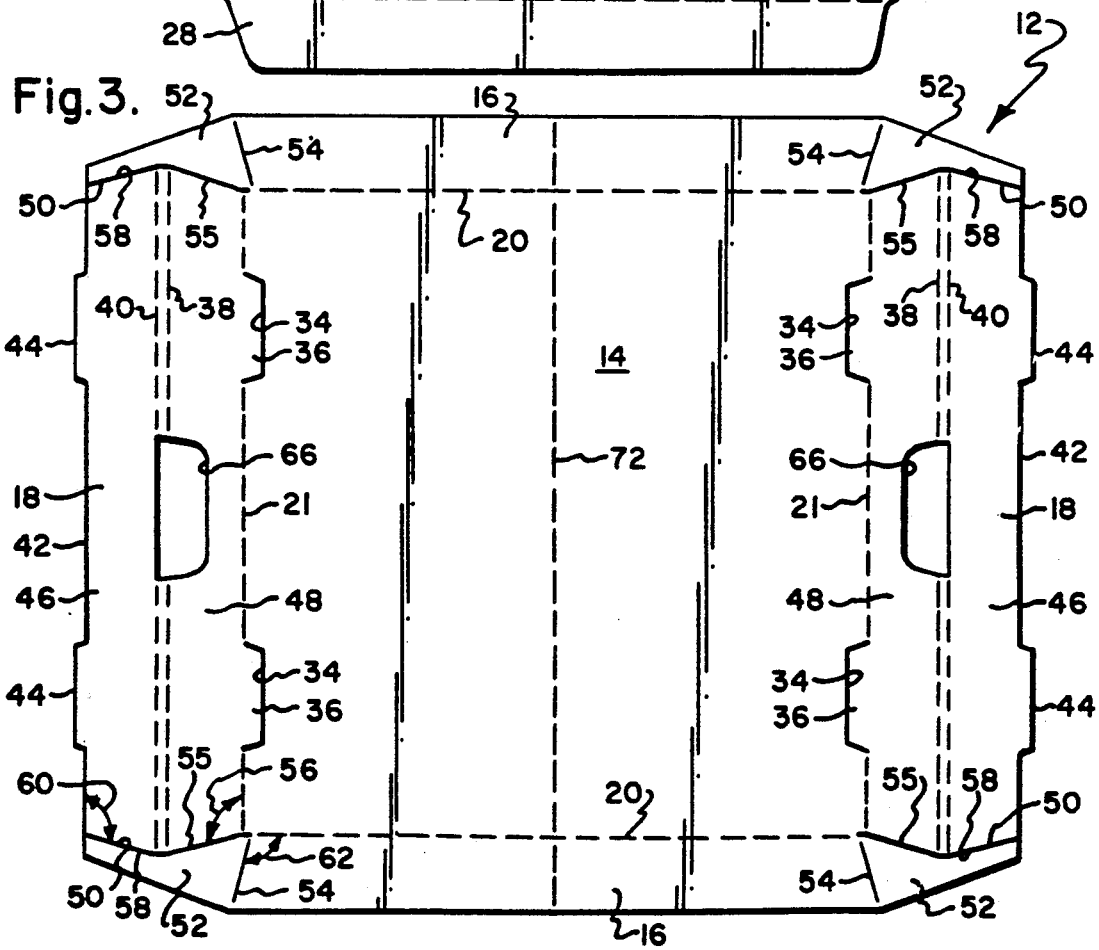
FIG. 3 is a plan view of a blank for the tray for the container of FIG. 1.

Referring to FIG. 3, the tray 12 is die-cut as a single piece from corrugated cardboard. The die-cutting operation includes the providing of crease lines and lines of perforations in the blank as hereinafter described. The blank 12 is perforated along each of the bottom wall edges 20 and 21. A pair of spaced three-sided cuts 34 are provided in the bottom wall 14 inwardly from each of the edges 21 to provide slots 34 in the bottom wall 14 when the second pair of side walls 18 are folded along edges 21 into an upstanding position. The edges 21 are not perforated along the lengths of the slots 34 so that when the second pair of side walls 18 are folded into an upstanding position, as shown in FIG. 4, the cut-outs 34 provide leg portions 36 on the side walls 18 which extend downwardly below the bottom wall 14 to act as legs for the tray whereby the bottom wall 14 may be raised slightly above a table top so as to prevent soak-through soiling of the table top. Each of the side walls 18 has a pair of closely spaced perforated lines 38 and 40 extending parallel to the respective edge 21 and centrally between the edge 21 and the terminal edge 42 thereof. A pair of tabs 44, corresponding in position and length to the slots 34, are provided along the terminal edge 42. Each of the second side walls 18 is folded about perforated lines 38 and 40 through an angle of 180° so as to provide an inner side wall portion 46 and an outer side wall portion 48 with the inner side wall portion 46 overlying the outer side wall portion 48 and the tabs 44 inserted in the slots 34 to secure the wall in an upstanding position.

The blank 12 is cut along lines 50 to provide end flaps 52 at each end of each of the first pair of side walls 16 and to define the end edges of each of the second pair of side walls 18. Thus, these end flaps 52 extend outwardly beyond the side walls 16. The side walls 16 are folded along creased but non-perforated lines 54 to form the end flaps 52 which are accordingly received between the inner and outer second side wall portions 46 and 48 respectively thereby allowing the blank 12 to be quickly and easily folded into the shape of a tray without the use of glue or the like.

The cuts 50 form end edges 55 to the outer end wall portion 48 which extend outwardly at an angle, illustrated at 56, relative to the respective edge 21 which is greater than 90° so that, as shown in FIG. 3, the outer portion 48 has the shape of a trapezoid. Angle 56 is preferably in the range of about 95° to 115°. For example, this angle 56 may perhaps be about 102°. The cuts 50 also provide end edges 58 to the inner wall portion 46 which edges 58 extend inwardly relative to the respective edge 21 from perforated line 40 to the terminal edge 42 thereby forming an angle, illustrated at 60, with the terminal edge 42 which is greater than 90°. This angle 60 between the end edge 58 and the terminal edge 42 is substantially equal to angle 56. Thus, when the second pair of side walls 18 are folded so that the inner and outer portions 46 and 48 respectively overlie each other, edges 58 and 55 will lie alongside each other so that the side walls 18 thus formed will have the shape of trapezoids. The crease lines 54 in the first pair of side walls 16 also extend outwardly relative to the respective edges 20 so as to form an angle, illustrated at 62, therewith which is also greater than 90° whereby the first pair of side walls 16 also have the shapes of trapezoids, the angle 62 being substantially equal to the angles 56 and 60. When the tray 12 is formed, each of the resulting trapezoidal-shaped walls inhibits the other walls from achieving an angle of 90° relative to the bottom wall 14 so that each of the side walls 16 and 18 slant outwardly from the bottom wall 14 at an angle, illustrated at 64 in FIGS. 4 and 5, which is substantially equal to angles 56, 60, and 62, yet a secure attachment of the walls to each other may be afforded thereby. This outward slope of the side walls permits nesting of the trays 12 each partially inside the other to minimize the space required therefor within a pizza shop. This also allows the bottom wall 14 to be made slightly smaller for savings of material or allows a greater amount of available space for insertion of the side walls 28 of the lid 22 so that the possibility of interference by the lid with the pizza may be reduced.

A cut-out or slot 66 is provided generally centrally of the length of each of the second pair of side walls 18 beginning at the inner line of perforations 40 and extending into the outer wall portion 48 over approximately half the height thereof, and corresponding in position and length to the tabs 32 to receive the tabs 32 in the slots 66 and between the inner and outer wall portions 46 and 48 respectively, as illustrated in FIG. 5. The extension of the slots 66 along the height of the outer wall portion 48 allows the tabs 32 to be easily inserted as well as gripped for easy removal of the lid from the tray. The tabs 32 are folded along lines 68 which are creased but non-perforated to allow the tabs 32 to have a spring effect and thereby bear against the outer wall portion 48, which spring effect is enhanced by the outwardly sloping side walls. This spring effect affords an increase in force against the outer side wall portion 48 when the upper wall of the lid is deflected inwardly, as illustrated at 70 in FIGS. 1 and 5, so as to afford a resistance to such deflection to prevent the lid from caving in on the pizza and thereby eliminate the need for a "barbie doll" table, an internal support which is sometimes provided in pizza boxes to prevent such an effect.

While a flat sheet of corrugated cardboard can generally be folded in half without a great deal of difficulty, the resistance thereof is greatly increased when the cardboard is provided in the shape of a tray with upstanding walls on each side. The large square shape of a pizza box is difficult to dispose of in a trash container or the like if it is not folded up. In order to allow the tray 12 to be easily folded in half for disposing thereof, in accordance with the present invention at least one fold line 72 is provided across the bottom wall 14 and extending beyond the bottom wall 14 through the height of the first pair of side walls, as illustrated in FIG. 3. In order to retain adequate strngth while also allowing ease of foldability, the fold line 72 is preferably a single line of perforations which is generally parallel to the edges 21 and generally midway between the edges 21 so that the tray 12 may be easily folded in half along the perforated line 72 for disposing thereof. The perforations are sized and spaced so as not to unduly sacrifice the strength of the bottom wall 14. For example, each of the perforations may have a length of perhaps about ⅜ inch, and they may be spaced apart a distance equal to about ⅜ inch. Other perforations in the container 10 may be similarly sized and spaced. Alternatively, the at least one fold line 72 may comprise a pair of fold lines each located a third of the distance across the bottom wall from the respective edge 21 whereby the tray may be folded in thirds, the fold line 72 may be provided from corner to corner of the tray, the fold line may be creased, or the fold line may comprise tear tape which is removable by pulling on a string.

For example, each of the legs 36 may be spaced a distance of perhaps 2 inches from the respective edge of the respective second side wall and extend over a length of perhaps of about 2½ inches. Each of the legs may have a height of perhaps about ¼ inch. The tabs 44 may be similarly sized and have a depth of perhaps about ¼ inch. Each of the tabs 32 may have a length of perhaps about 3 inches and a width of perhaps about 1½ inch, and each of the slots 66 may have a length of perhaps about 3 inches and extend over a height of perhaps about 1 inch. It should of course be understood that the present invention is not limited to such sizes and dimensions and may include other sizes and dimensions as may be suitable.

The container 10 may be constructed by first die-cutting with the cutting and perforating and creasing all being performed in the same die-cutting operation to form the blanks substantially as shown in FIGS. 2 and 3 for the lid 22 and the tray 12 respectively. The blanks are shipped to the pizza shop in that condition and are assembled at the pizza shop ideally during a slack period of time and stored in the limited space available until use thereof. In order to form the tray, the side walls are folded along the perforated bottom wall edges 20 and 21 into upstanding positions, and the second pair of side walls 18 are doubled over along the double perforated lines 38 and 40 so as to cause the inner portion 46 to overlie the outer portion. The first set of side walls are folded along crease lines 54, and the resulting end flaps 52 are inserted between the inner and outer portions 46 and 48 respectively. The tabs 44 are then snapped into the slots 34 to provide a secure tray which may be nested with other trays to save space within the pizza shop. The lids 22 may be stored as blanks. When it is time to use the container 10, the pizza is placed on the bottom wall 14, the lid is folded along perforated edges 26 and crease lines 68, and the resulting side walls 28 are inserted into the tray 12 to engage the inner surfaces of the first set of side walls 16 and the resulting tabs 32 inserted into the slots 66 and between the inner and outer portions 46 and 48 respectively to effect a secure attachment which is resistant to downward forces 70 on the lid so that the pizza is protected from such downward forces. When it is time to consume the pizza, the legs 36 conveniently allow the bottom wall 14 to be raised slightly above the surface of a table top so as to ensure against soiling of the table top and, if desired, the lid 22, which may be removed out of the way, may be placed under the tray 12. When it is time to dispose of the container after consumption of the pizza, the lid 22 may be easily folded and, since it is not soiled, may be placed into a bin for recycling. The tray 12 may be easily folded along the line of perforations 72 so that it may be easily disposed of.

The features of the two-piece corrugated cardboard construction, the sloping side walls, the legs, the insertion of the tabs 32 between the inner and outer portions 46 and 48 respectively, and the line of perforations 72 for folding the tray advantageously relate to each other so as to provide what might be called a "symphony" of interrelated inventive features.

It should be understood that while the invention has been described in detail herein, the invention can be embodied otherwise without departing from the principles thereof. For example, the slots 66 may be provided in the inner side wall portions 46. For another example, fold lines which are described herein as being perforated may instead be creased, and those described as creased may instead be perforated. Such other embodiments are meant to come within the scope of the present invention as defined by the appended claims.

What is claimed is:

1. A two-piece container for pizza, the container comprising a base and a lid, said base and said lid being two separate pieces, said lid composed of corrugated cardboard and comprising a square upper wall for the container, said base composed of corrugated cardboard and comprising a square bottom wall, a first pair of opposite side walls, a second pair of opposite side walls, and fold line means in said bottom wall and said first pair of side walls midway between said second pair of side walls for folding the base in half for disposal.

2. A container according to claim 1 wherein said second pair of side walls each comprises an inner and an outer overlying wall portion.

3. A two-piece container for pizza, the container comprising a base and a lid, said base and said lid being two separate pieces, said lid composed of corrugated cardboard and comprising a square upper wall for the container, said base composed of corrugated cardboard and comprising a square bottom wall, a first pair of opposite side walls, a second pair of opposite side walls, and a single line of perforations in said bottom wall and said first pair of side walls midway between said second pair of side walls for folding the base in half for disposal.

4. A container according to claim 3 wherein said perforations in said line of perforations have substantially equal lengths and are spaced to have spacings which are substantially equal to the lengths of the perforations.

5. A container according to claim 4 wherein each of the perforations in said line of perforations has a length of about ⅜ inch.

6. A container according to claim 3 wherein said second pair of side walls each comprises an inner and an outer overlying wall portion.

7. A two-piece container comprising a base and a lid, said lid comprising a generally rectangular wall having a first pair of opposite edges and a second pair of opposite edges, each of said second pair of opposite edges having at least one tab foldably connected thereto, said base comprising a generally rectangular bottom wall having a first and second pair of opposite edges, a first pair of side walls foldably connected to said bottom wall along said first pair of opposite edges respectively of said bottom wall, each of said first pair of side walls including a pair of end flaps, a second pair of side walls foldably connected to said bottom wall along said second pair of opposite edges respectively of said bottom wall, each of said second pair of side walls having gold line means about which said respective second side wall is foldable to define inner and outer wall portions and to position an edge of said respective second side wall adjacent said bottom wall, at least one tab extending from said second side wall edge, slot means in said bottom wall for receiving said tab, each of said flaps being receivable between said inner and outer wall portions of said respective second side wall of said base, means defining at least one cut-out in said fold line means of each of said second pair of side walls of said base for receiving said lid tabs between said inner and outer wall portions of said pair of second side walls respectively, and said inner and outer wall portions each having the shape of a trapezoid to effect an outward slope to the first and second pairs of side walls for nesting of the base with others of the base.

8. A container according to claim 7 further comprising means defining crease lines along which said lid tabs are foldable for providing a spring effect to said lid tabs.

9. A container according to claim 8 wherein each of said cut-out means extends from said respective fold line means into said respective outer wall portion.

10. A container according to claim 7 further comprising a pair of opposite side walls foldably attached to said first pair of opposite edges respectively of said lid for engaging inner surfaces of said first pair of side walls of said base.

11. A container according to claim 7 wherein said base and said lid are composed of corrugated cardboard.

12. A container according to claim 11 wherein said bottom wall and said lid rectangular wall are square, said base further comprising means defining at least one fold line in said bottom wall and said first pair of side walls for folding the base for disposal.

13. A container according to claim 7 wherein each of said first pair of side walls has the shape of a trapezoid.

14. A two-piece container comprising a base and a lid, said lid comprising a generally rectangular wall having a first pair of opposite edges and a second pair of opposite edges, each of said second pair of opposite edges having at least one tab foldably connected thereto, said base comprising a generally rectangular bottom wall having a first and second pair of opposite edges, a first pair of side walls foldably connected to said bottom wall along said first pair of opposite edges respectively of said bottom wall, each of said first pair of side walls including a pair of end flaps, a second pair of side walls foldably connected to said bottom wall along said second pair of opposite edges respectively of said bottom wall, each of said second pair of side walls being foldable to define inner and outer wall portions to position an edge of said respective second side wall adjacent said bottom wall, at least one tab extending from said second side wall edge, slot means in said bottom wall for receiving said tab, each of said flaps being receivable between said inner and outer wall portions of said respective second side wall of said base, means defining at least one cut-out in each of said second pair of side walls of said base for receiving said lid tabs between said inner and outer wall portions of said pair of second side walls respectively, said inner and outer wall portions each having the shape of a trapezoid to effect an outward slope to the first and second pairs of side walls for nesting of the base with others of the base, and aid cut-out means extending over substantially half of the height of said outer wall portion.

15. A container according to claim 14 wherein each of said first pair of side walls has the shape of a trapezoid.

16. A container according to claim 14 wherein the base and the lid are composed of corrugated cardboard.

17. A container according to claim 16 further comprising means defining at least one fold line in said bottom wall and said first pair of side walls for folding the base for disposal.

18. A container according to claim 14 further comprising a plurality of legs extending from each of said outer wall portions to raise the base above a table top, each of said legs formed by a cut from the respective one of said second pair of edges into said bottom wall to form said respective slot means.

19. A container according to claim 14 further comprising means defining crease lines along which said lid tabs are foldable for providing a spring effect to said lid tabs.

20. A two-piece container for pizza, the container comprising a lid and a base, said base and said lid being two separate pieces each of which is composed of corrugated cardboard, said lid comprising a square wall having a first pair of opposite edges and a second pair of opposite edges, each of said second pair of opposite edges having at least one tab foldably connected thereto, said base comprising a square bottom wall having a first pair of opposite edges and a second pair of opposite edges, a first pair of side walls foldably connected to said bottom wall along said first pair of opposite edges respectively of said bottom wall, each of said first pair of side walls including a pair of end flaps, a second pair of side walls foldably connected to said bottom wall along said second pair of opposite edges respectively of said bottom wall, each of said second pair of side walls having fold lien means about which said respective second side wall is foldable to define inner and outer wall portions and to position an edge of said respective second side wall adjacent said bottom wall, at least one tab extending from said second side wall edge, slot means in said bottom wall for receiving said tab, each of said flaps being receivable between said inner and outer wall portions of said respective second side wall of said base, means defining at least one cut-out in each of said second pair of side walls of said base for receiving said lid tabs between said inner and outer wall portions of said pair of second side walls respectively, and said base further comprising fold line means in said bottom wall and said first pair of side walls midway between said second pair of side walls for folding the base in half for disposal.

21. A container according to claim 20 wherein said inner and outer wall portions each has the shape of a trapezoid to effect an outward slope to the first and second pairs of side walls for nesting of the base with others of the base.

22. A container according to claim 20 wherein each of said cut-out means extends from said respective second side wall fold line means into said respective outer wall portion, the container further comprising means defining crease lines along which said lid tabs are foldable for providing a spring effect to said lid tabs whereby said lid tabs bear against said respective outer wall portions to resist inward movement of the lid toward the bottom wall.

* * * * *